US009347199B2

(12) United States Patent
Gendron et al.

(10) Patent No.: US 9,347,199 B2
(45) Date of Patent: May 24, 2016

(54) SUPPORT FRAME FOR AN IMPLEMENT

(71) Applicant: Soucy International Inc., Drummondville (CA)

(72) Inventors: Jean-Philippe Gendron, Drummondville (CA); Jérémie Aubin-Marchand, St-Hugues (CA); Normand Roy, St-Hugues (CA)

( * ) Notice: Subject to any disclaimer, the term of this patent is extended or adjusted under 35 U.S.C. 154(b) by 189 days.

(21) Appl. No.: 13/772,661

(22) Filed: Feb. 21, 2013

(65) Prior Publication Data

US 2013/0214106 A1 Aug. 22, 2013

Related U.S. Application Data

(60) Provisional application No. 61/601,086, filed on Feb. 21, 2012.

(51) Int. Cl.
*E02F 3/76* (2006.01)
*E01H 5/06* (2006.01)

(52) U.S. Cl.
CPC ..... *E02F 3/7631* (2013.01); *E01H 5/062* (2013.01); *E01H 5/066* (2013.01)

(58) Field of Classification Search
USPC ..... 37/231, 235, 236; 172/272, 273, 810, 172/811, 817, 828, 829, 816
See application file for complete search history.

(56) References Cited

U.S. PATENT DOCUMENTS

| | | | | |
|---|---|---|---|---|
| 271,432 | A * | 1/1883 | Diefendorf et al. | 172/711 |
| 301,545 | A * | 7/1884 | Wheeler | 172/265 |
| 338,709 | A * | 3/1886 | Brown | 172/711 |
| 355,906 | A * | 1/1887 | Ady et al. | 172/265 |
| 1,195,271 | A * | 8/1916 | Ruth | 37/232 |
| 2,134,848 | A * | 11/1938 | Anderson | 37/232 |
| 2,144,311 | A | 1/1939 | Klauer | |
| 2,144,312 | A | 1/1939 | Klauer | |
| 2,144,313 | A | 1/1939 | Klauer | |
| 2,144,314 | A | 1/1939 | Klauer | |
| 2,216,782 | A | 10/1940 | Klauer | |
| 2,614,344 | A | 10/1952 | Rust | |

(Continued)

FOREIGN PATENT DOCUMENTS

CA 2117823 4/1996

OTHER PUBLICATIONS

Quadboss UTV Articulating Push Tube Owner's Manual, Aug. 1, 2011, 7 pages, Quadboss, United States.

*Primary Examiner* — Matthew D Troutman
(74) *Attorney, Agent, or Firm* — Robert Brouillette; Brouillette & Partners

(57) ABSTRACT

A frame for supporting an implement (e.g. a plow) on a vehicle is disclosed. The support frame extends longitudinally and generally comprises, at its rear end, a rear attachment mechanism for removably mounting the support frame to the underside of the vehicle, and at its front end, a front attachment assembly for supporting the implement. The frame comprises a rear section and a front section hingedly connected together such that the front section can pivot upwardly with respect to the rear section. The support frame also comprises a biasing assembly or mechanism, generally comprising a resilient member engaging the front and rear sections, such as to downwardly bias the front portion. By overcoming the downward bias of the biasing assembly, the front section can be further raised with respect to the ground surface, thereby providing greater clearance.

16 Claims, 17 Drawing Sheets

(56) References Cited

U.S. PATENT DOCUMENTS

| | | | | | |
|---|---|---|---|---|---|
| 3,440,739 | A | | 4/1969 | Manke | |
| 3,643,746 | A | * | 2/1972 | Dedoes | 172/445 |
| 3,845,577 | A | * | 11/1974 | Naymik | 37/231 |
| 4,570,367 | A | * | 2/1986 | Oya | 34/232 |
| 4,615,130 | A | | 10/1986 | Racicot | |
| 4,793,626 | A | * | 12/1988 | Gefroh | 280/478.1 |
| 4,800,964 | A | * | 1/1989 | Rettig et al. | 172/711 |
| 4,825,570 | A | | 5/1989 | Schmid | |
| 4,860,672 | A | * | 8/1989 | Zimmerman | 111/84 |
| 4,976,053 | A | * | 12/1990 | Caley | 37/231 |
| 5,136,795 | A | * | 8/1992 | Rosenberg | 37/233 |
| 5,195,261 | A | | 3/1993 | Vachon | |
| 5,615,745 | A | | 4/1997 | Cross | |
| 5,967,241 | A | | 10/1999 | Cross | |
| 6,050,008 | A | * | 4/2000 | Doornek et al. | 37/231 |
| 6,178,668 | B1 | | 1/2001 | Gustafson | |
| 6,202,328 | B1 | * | 3/2001 | Fulton | 37/231 |
| RE37,628 | E | | 4/2002 | Segorski | |
| 6,484,421 | B1 | | 11/2002 | Donoghue | |
| 6,502,334 | B1 | | 1/2003 | Davies | |
| 6,615,513 | B2 | * | 9/2003 | Quenzi et al. | 37/231 |
| 6,843,002 | B1 | | 1/2005 | Moffitt | |
| 6,941,685 | B2 | * | 9/2005 | Goy et al. | 37/232 |
| 6,957,505 | B1 | | 10/2005 | Moffitt | |
| 7,028,423 | B1 | * | 4/2006 | Curry | 37/236 |
| 7,093,380 | B2 | | 8/2006 | Hubscher | |
| 7,219,453 | B2 | * | 5/2007 | Baker | 37/232 |
| 7,302,765 | B1 | | 12/2007 | Jorgenson | |
| 7,426,795 | B2 | * | 9/2008 | Raddon | 37/241 |
| 7,975,407 | B2 | | 7/2011 | Dilworth | |
| 8,046,938 | B1 | | 11/2011 | Jorgenson | |
| 8,689,898 | B2 | * | 4/2014 | Benesch | 172/829 |
| 8,763,280 | B1 | * | 7/2014 | Fournier et al. | 37/235 |
| 8,769,847 | B2 | * | 7/2014 | Coulombe et al. | 37/231 |
| 2002/0088149 | A1 | * | 7/2002 | Quenzi et al. | 37/231 |
| 2004/0148811 | A1 | | 8/2004 | Harris | |
| 2005/0166428 | A1 | * | 8/2005 | Hollinrake et al. | 37/231 |
| 2006/0005433 | A1 | | 1/2006 | Curtis | |
| 2006/0086008 | A1 | | 4/2006 | Hubscher | |
| 2007/0084089 | A1 | | 4/2007 | Shoemaker | |
| 2008/0104865 | A1 | | 5/2008 | Bailey | |
| 2010/0025058 | A1 | * | 2/2010 | Carter et al. | 172/817 |
| 2011/0173847 | A1 | | 7/2011 | Ropog | |
| 2011/0225853 | A1 | | 9/2011 | Dilworth | |

* cited by examiner

SUPPORT FRAME FOR AN IMPLEMENT

CROSS-REFERENCE TO RELATED APPLICATIONS

The present patent application claims the benefits of priority of U.S. Provisional Patent Application No. 61/601,086, entitled "Support Frame for an Implement" and filed at the United States Patent and Trademark Office on Feb. 21, 2012; the content of which is incorporated herein by reference.

FIELD OF THE INVENTION

The present invention generally relates to frames and frame assemblies for supporting implements on vehicles and more particularly relates to frames and frame assemblies for supporting implements on small vehicles such as, but not limited to, all-terrain vehicles ("ATV" or "ATVs") and utility-terrain vehicle ("UTV" or "UTVs").

BACKGROUND OF THE INVENTION

All-terrain vehicles ("ATV" or "ATVs"), utility-terrain vehicle ("UTV" or "UTVs"), and other similar vehicles, are often equipped with implements such as plows to allow the vehicles to displace snow, dirt, soil, gravel, etc. Such implements are typically removably mounted to the vehicles via appropriate supporting frames or supporting frame assemblies.

Though several different configurations of supporting frames have been proposed and devised throughout the years, most supporting frames can be categorized either as front-mounted (i.e. mounted to the front of the vehicle) or as underside-mounted (i.e. mounted to the underside of the vehicle).

A front-mounted supporting frame is generally configured to be mounted near or at the front end of the vehicle. Hence, due to its frontal position, the front-mounted supporting frame typically allows the implement to be easily raised when not in use.

However, due to its frontal position, the front-mounted supporting frame is typically less effective at distributing the load that the implement transfers to the vehicle when in use. This is generally caused by the relatively large operating angle of the supporting frame with respect to the frame of the vehicle when the implement is in use.

The underside-mounted supporting frame mitigates some of the shortcomings of front-mounted supporting frames, and more particularly the load distribution problem mentioned above. Indeed, as the underside-mounted frame is mounted underneath the vehicle, typically between the front and rear wheels, the supporting frame defines a smaller operating angle with respect to the frame of the vehicle, and the load generated by the implement is thereby more evenly transferred to the frame of the vehicle.

However, despite the foregoing advantage, an underside-mounted supporting frame typically has less ground clearance than a front-mounted supporting frame since the frame cannot be raised as high as a front-mounted supporting frame. Indeed, in an underside-mounted supporting frame, the supporting frame ultimately abuts on the underside of the vehicle when it is raised by the winch.

There is therefore a need for an improved underside-mounted supporting frame which mitigates at least some of the aforementioned shortcomings.

SUMMARY OF THE INVENTION

At least some of the shortcomings of prior art support frames for implements are mitigated by a support frame which comprises a front section hingedly connected to a rear section and which is downwardly biased by a biasing assembly.

Hence, a support frame for an implement, in accordance with the principles of the present invention, generally extends longitudinally and generally comprises, at its rear end, a rear attachment mechanism for removably mounting the rear end of the support frame to the underside of the vehicle, and at its front end, an implement attachment assembly for supporting the implement.

The rear attachment mechanism typically allows the support frame to pivot with respect to the vehicle, thereby allowing the support frame to be raised and lowered as needed, typically by the winch of the vehicle. In typical though non-limitative embodiments of the support frame, the rear attachment mechanism is a latching mechanism that comprises one or more latches (e.g. two latches).

The support frame also comprises a rear section and a front section hingedly connected thereto. The hinge connection between the front and rear sections is configured to allow the front section to be pivotable between an operative position wherein the front section is substantially not pivoted with respect to the rear section, and an inoperative position wherein the front section is pivoted upwardly with respect to the rear section. Hence, the hinge connection between the front and rear sections generally allows only upward pivotal movements of the front section with respect to the rear section.

The support frame also comprises a biasing assembly or mechanism which downwardly biases the front section into the operative position.

Still, in accordance with the principles of the present invention, the downward bias of the biasing assembly can be overcome, typically by the winch of the vehicle, such as to allow the front section to pivot upwardly with respect to the rear section (i.e. in the inoperative position) in order to provide more clearance between the implement and the ground surface.

In typical though non-limitative embodiments of a support frame, the support frame is configured to support a plow.

Other and further aspects and advantages of the present invention will be obvious upon an understanding of the illustrative embodiments about to be described or will be indicated in the appended claims, and various advantages not referred to herein will occur to one skilled in the art upon employment of the invention in practice. The features of the present invention which are believed to be novel are set forth with particularity in the appended claims.

BRIEF DESCRIPTION OF THE DRAWINGS

The above and other aspects, features and advantages of the invention will become more readily apparent from the following description, reference being made to the accompanying drawings in which:

FIG. 12 is a fragmentary side perspective view of the support frame of FIG. 11.

DETAILED DESCRIPTION OF THE PREFERRED EMBODIMENT

A novel support frame for an implement will be described hereinafter. Although the invention is described in terms of specific illustrative embodiments, it is to be understood that the embodiments described herein are by way of example only and that the scope of the invention is not intended to be limited thereby.

Figure 10A:
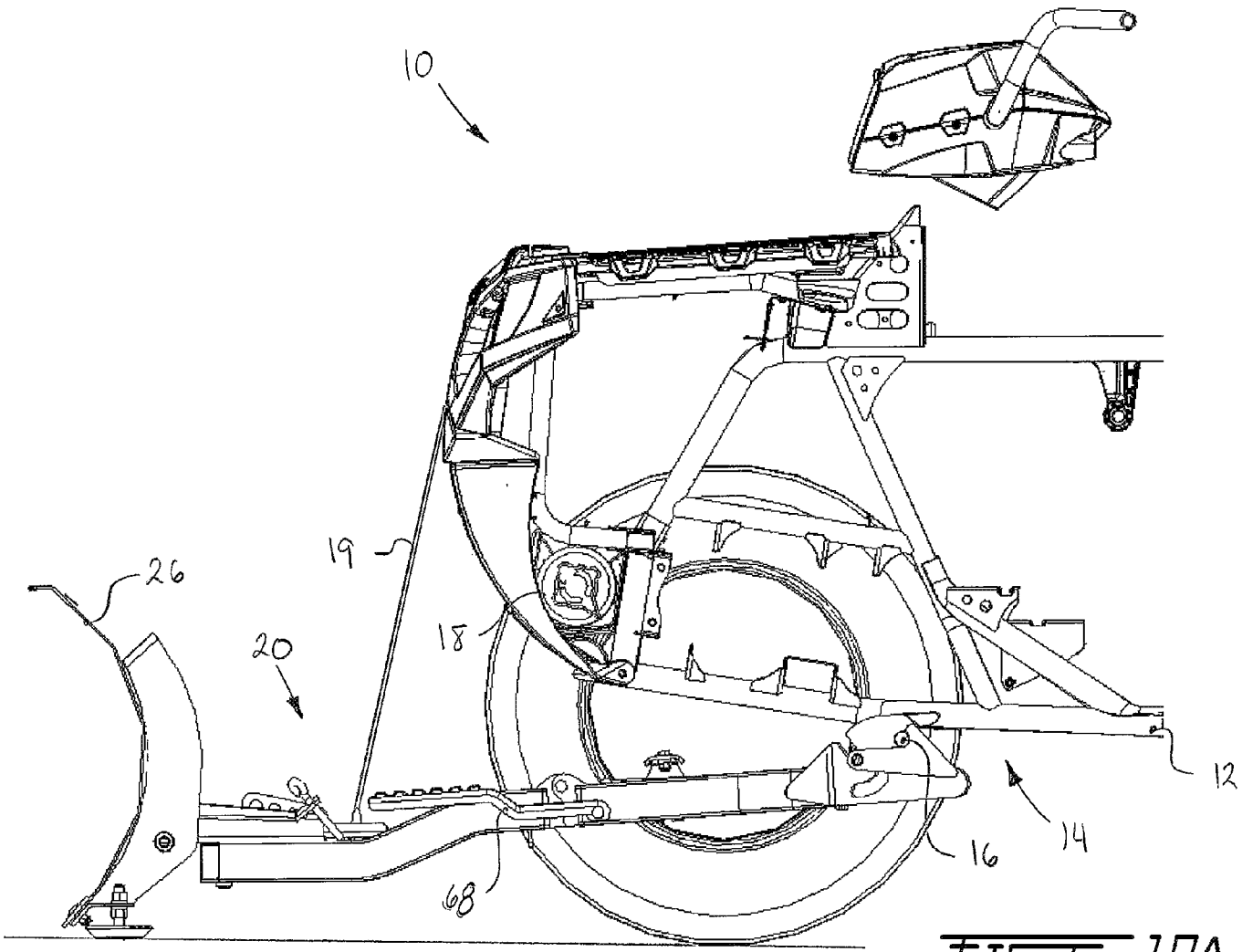
FIGS. 10A to 10C are sequential side views of the support frame of FIG. 1, mounted to an ATV, during the raising of the support frame.
Figure 10B:
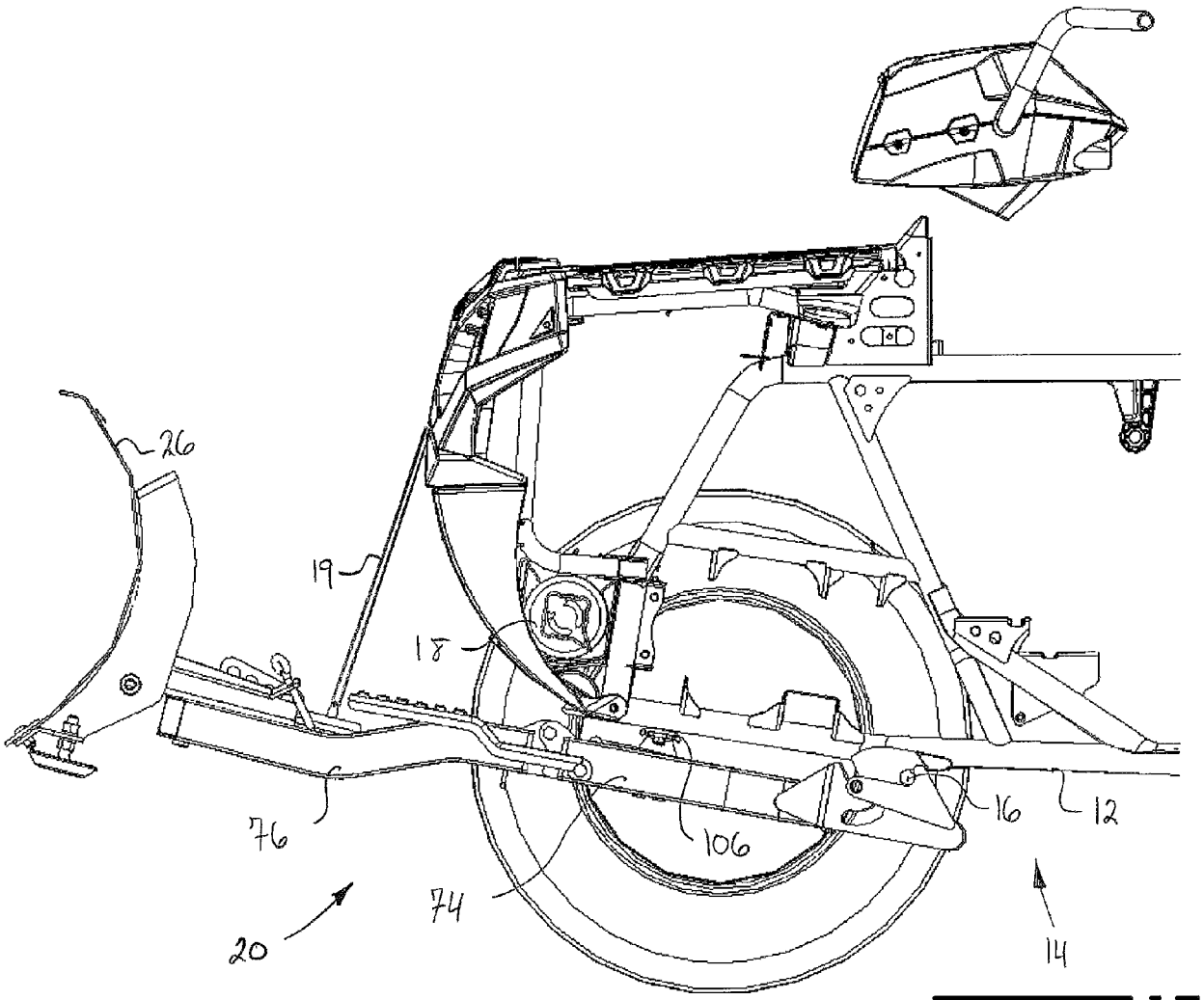
Figure 10C:
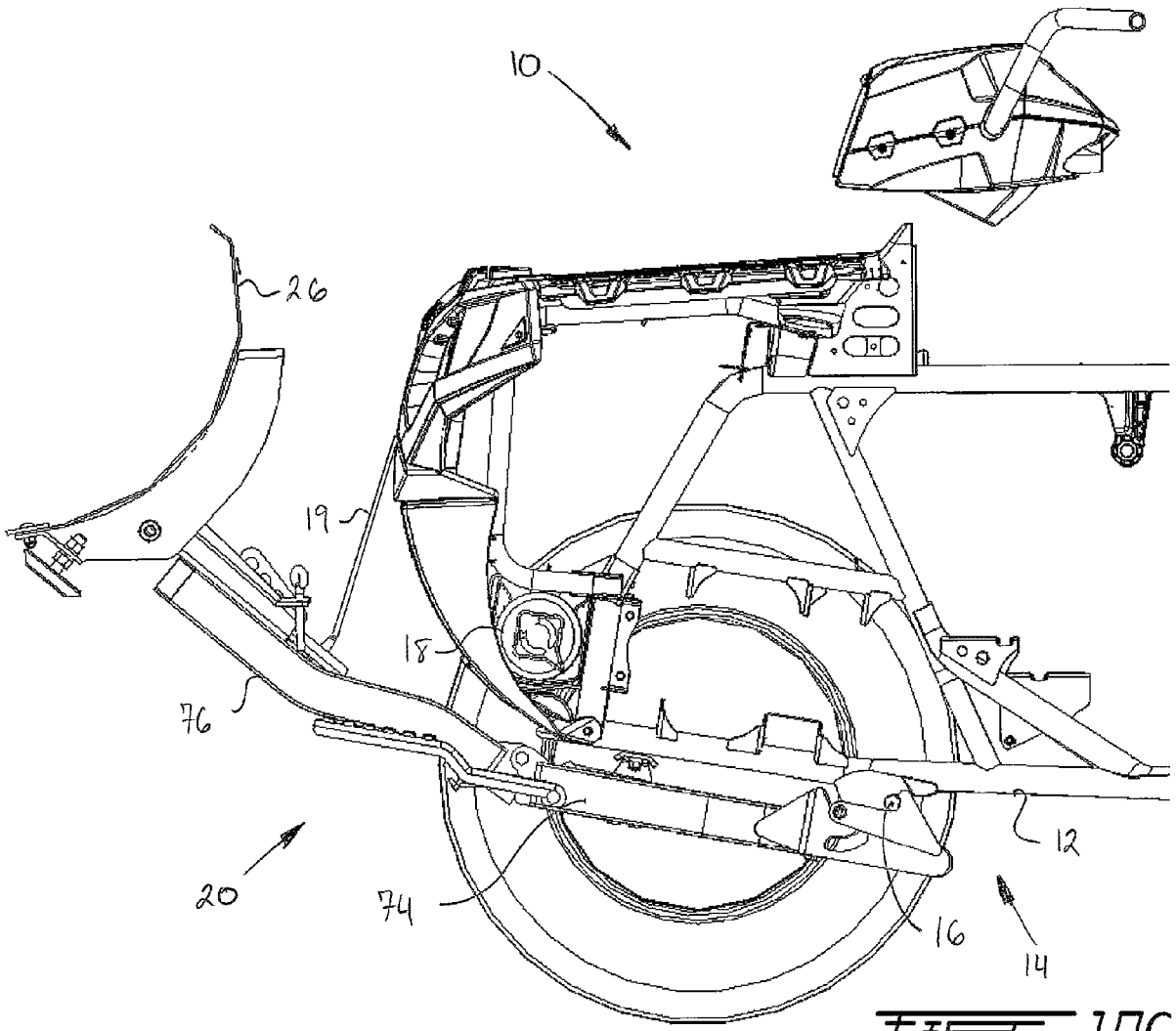
Figure 11:
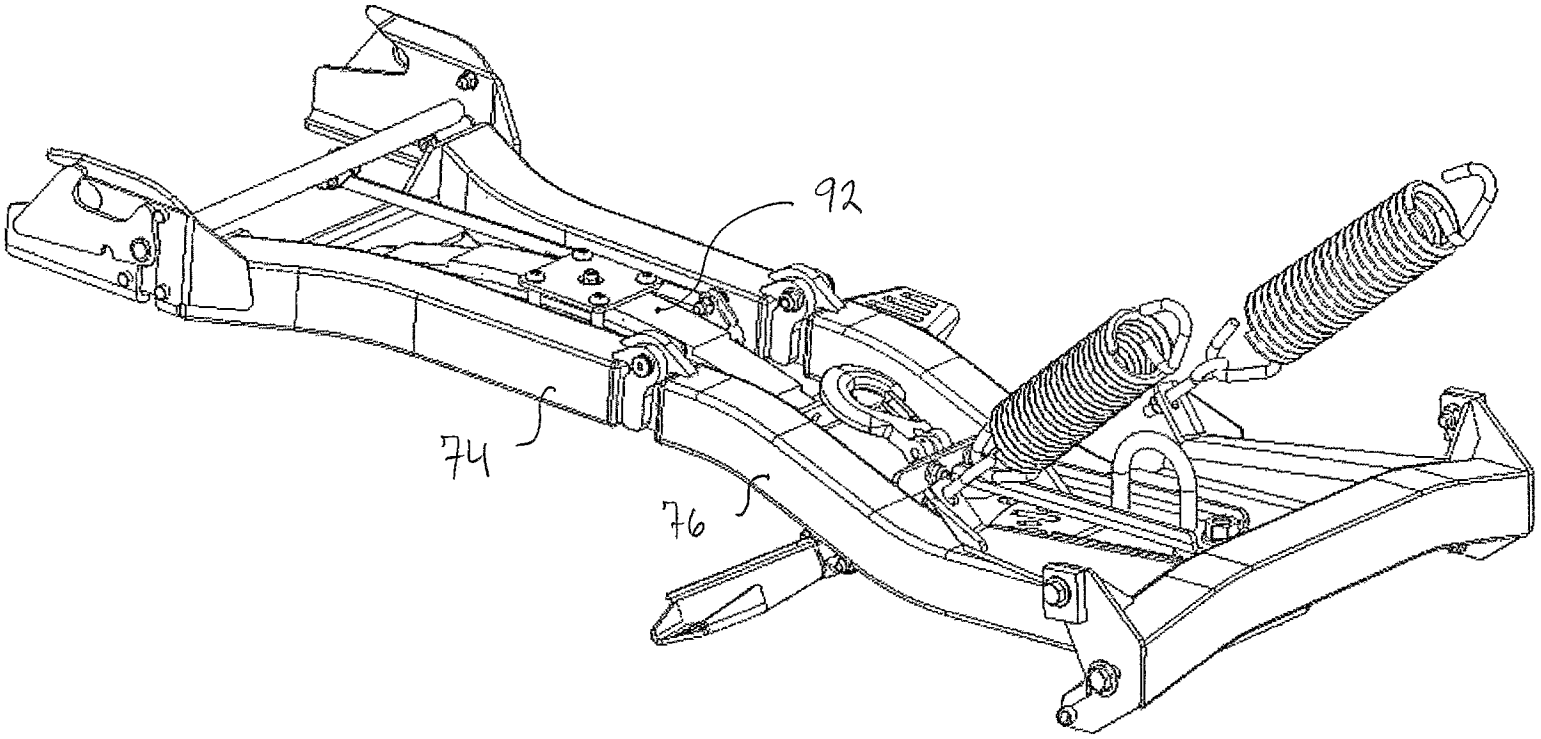
FIG. 11 is a front perspective view of another support frame in accordance with the principles of the present invention.
Figure 17:
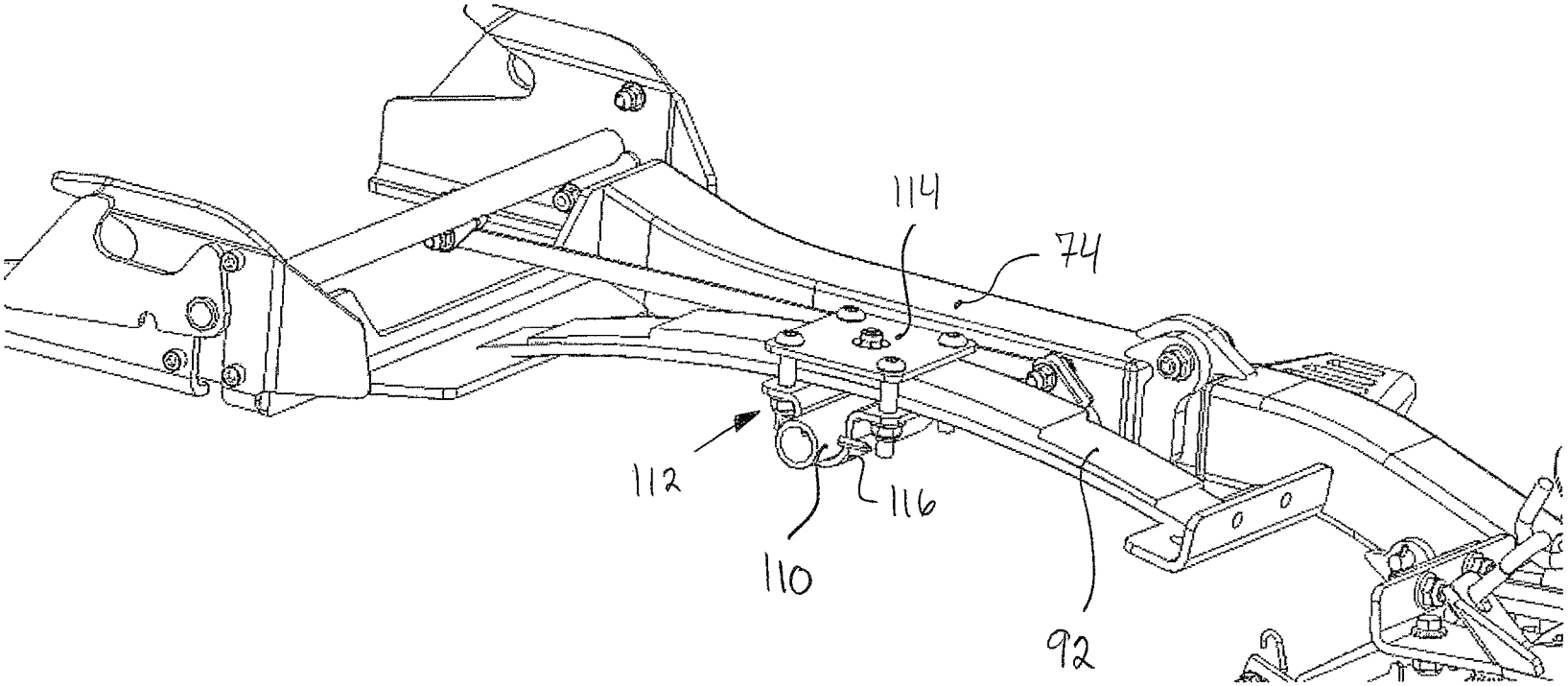
Figure 13:
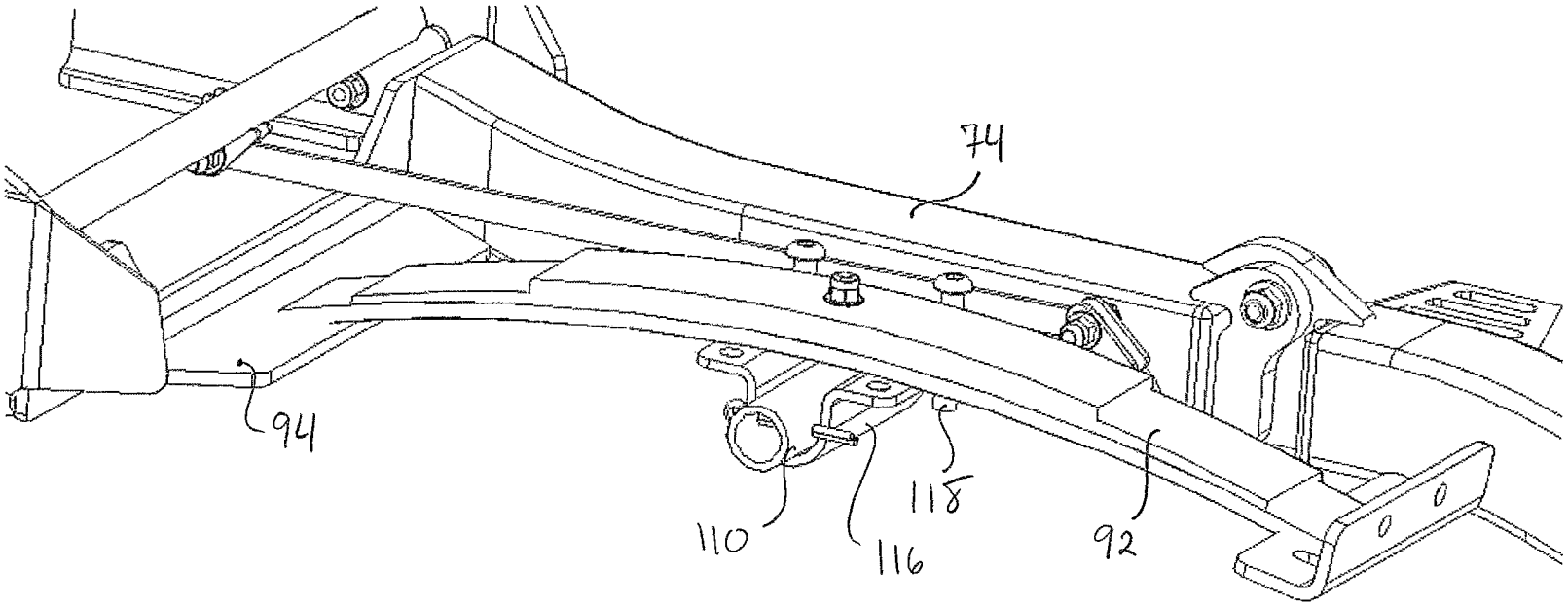
FIG. 13 is another fragmentary side perspective view of the support frame of FIG. 11.
Figure 14:
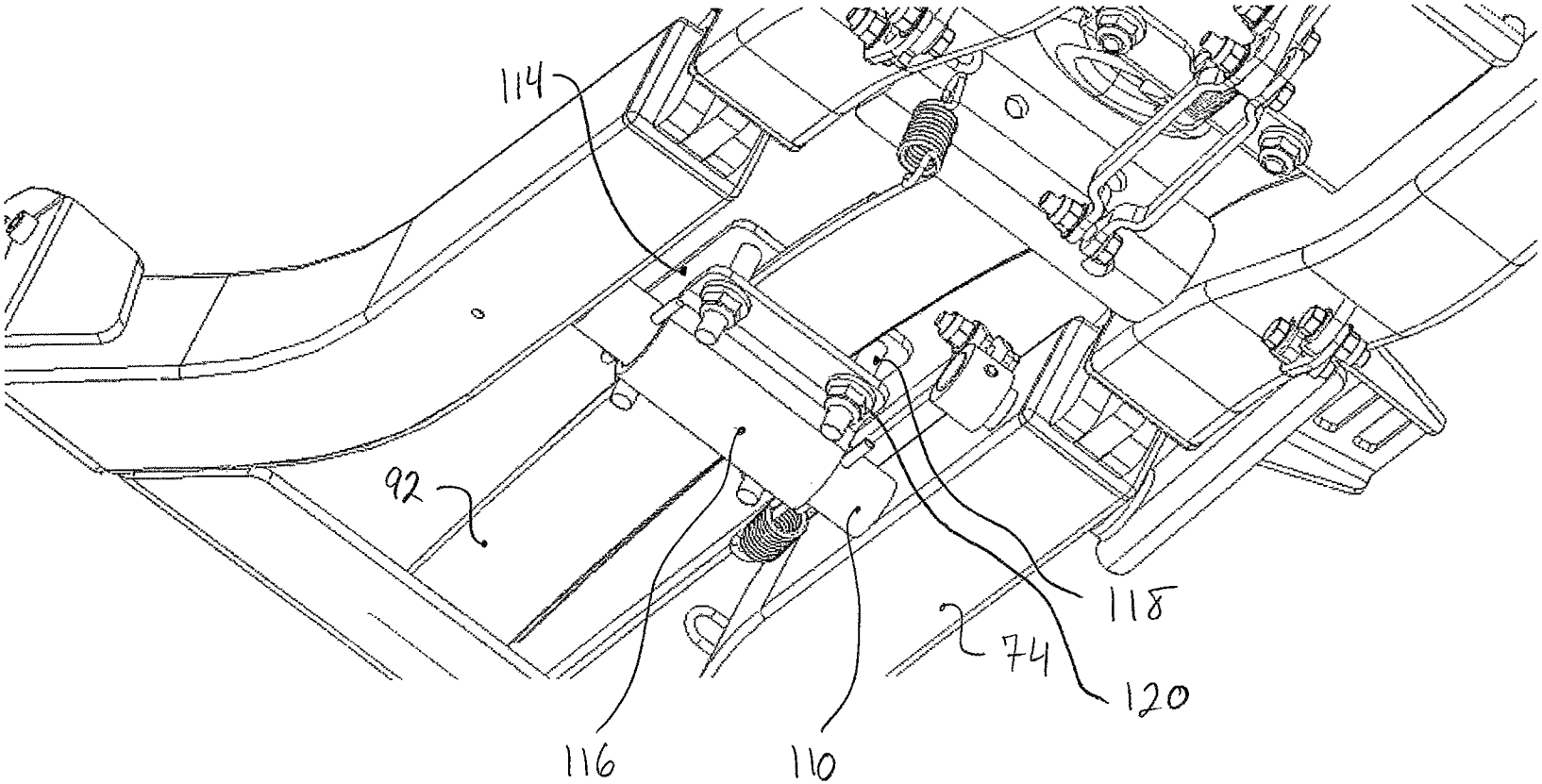
FIG. 14 is a partial bottom perspective view of the support frame of FIG. 11.
Figure 15:
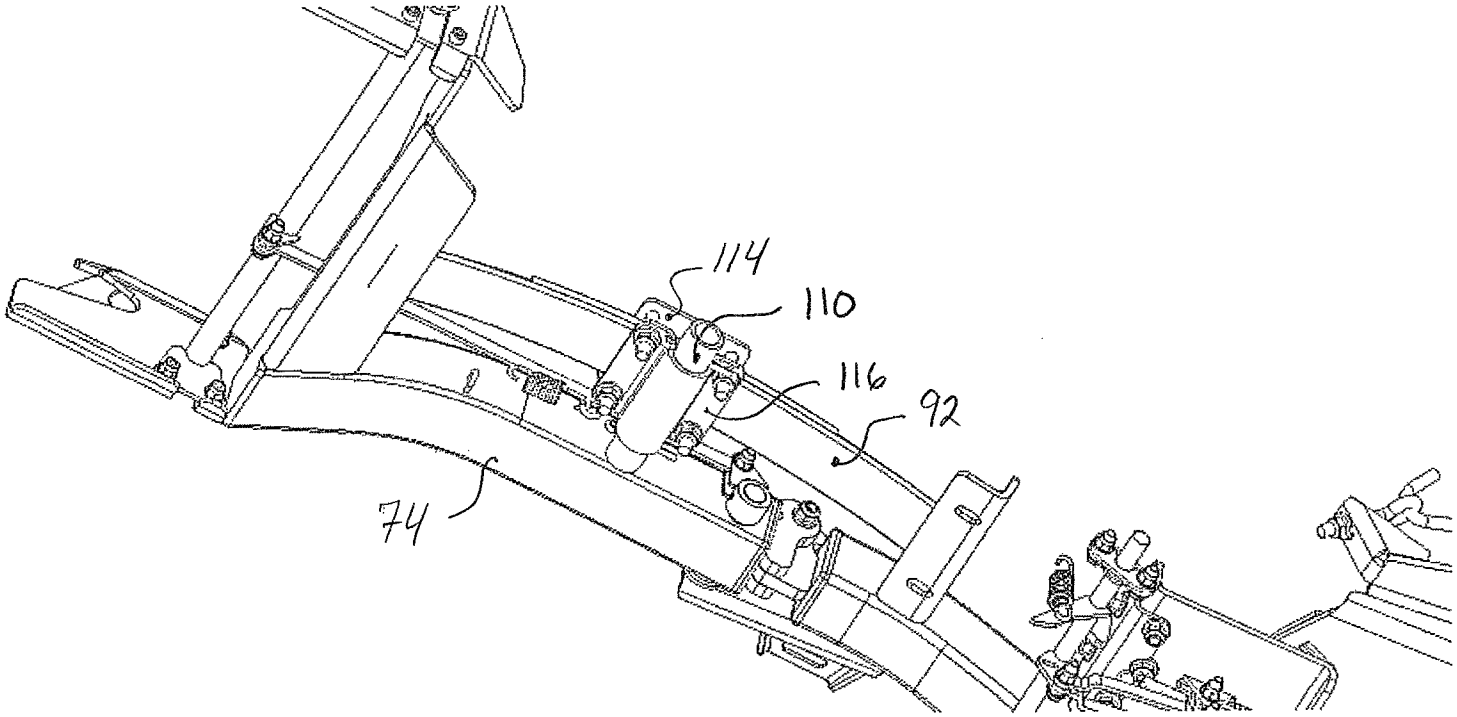
FIG. 15 is a fragmentary partial bottom perspective view of the support frame of FIG. 11.

Referring first to FIGS. 10A to 10C, an embodiment of a support frame 20, in accordance with the principles of the present invention, is depicted mounted to a vehicle 10. In FIGS. 10A to 10C, the vehicle 10 is an ATV. However, the vehicle 10 could be a UTV or any other similar small vehicles.

In the present embodiment, the support frame 20 is pivotally mounted to a mounting rod 16 located on the underside 14 of the frame 12 of the vehicle 10. The mounting rod 16 can be either mounted to the underside 14 of the frame 12 or integral therewith. As it will be best understood below, this pivotal connection between the support frame 20 and the frame 12 allows the implement mounted to the support frame 20 to be lowered toward the ground in a working position (see FIG. 10A), and raised from the ground in an non-working position (see FIGS. 10B and 10C). In other embodiments, the support frame 20 could be mounted to the underside 14 of the vehicle 10 via different attachment mechanisms. However, these other attachment mechanisms must still allow the support frame 20 to pivot with respect to the frame 12 of the vehicle 10.

Figure 1:
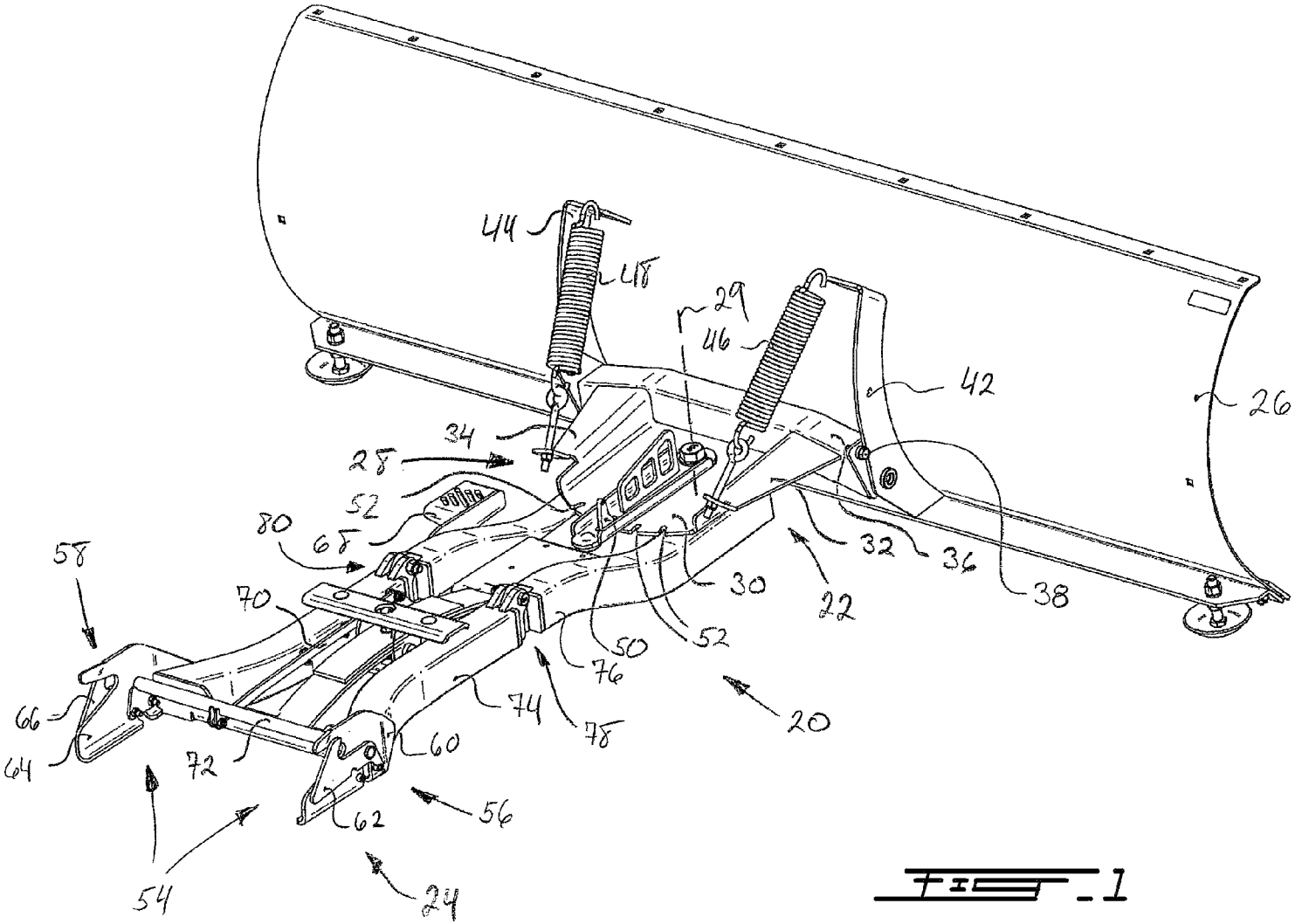
FIG. 1 is a rear perspective view of a support frame in accordance with the principles of the present invention and equipped with a plow.
Figure 2:
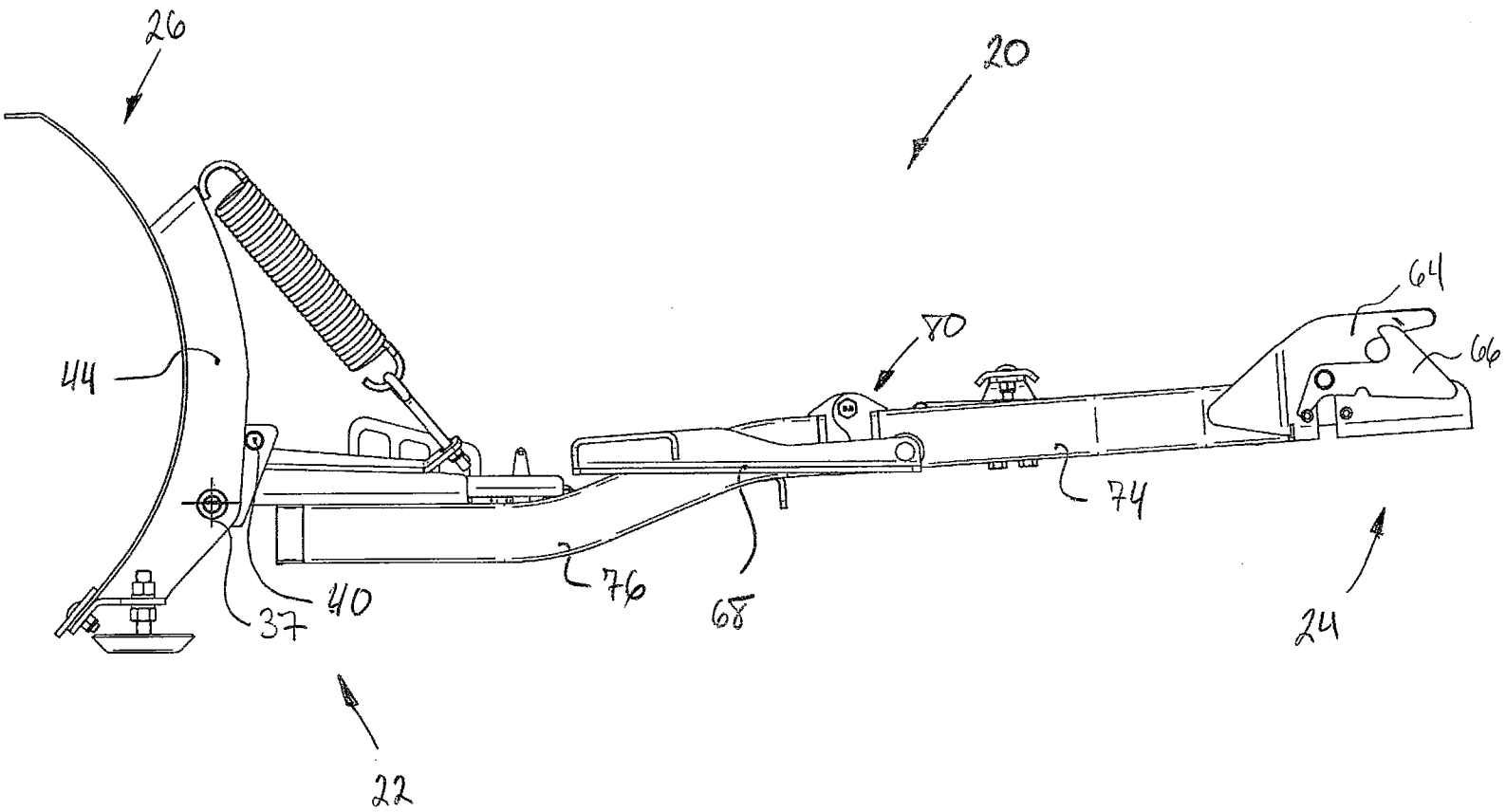
FIG. 2 is a side view of the support frame of FIG. 1.
Figure 3:
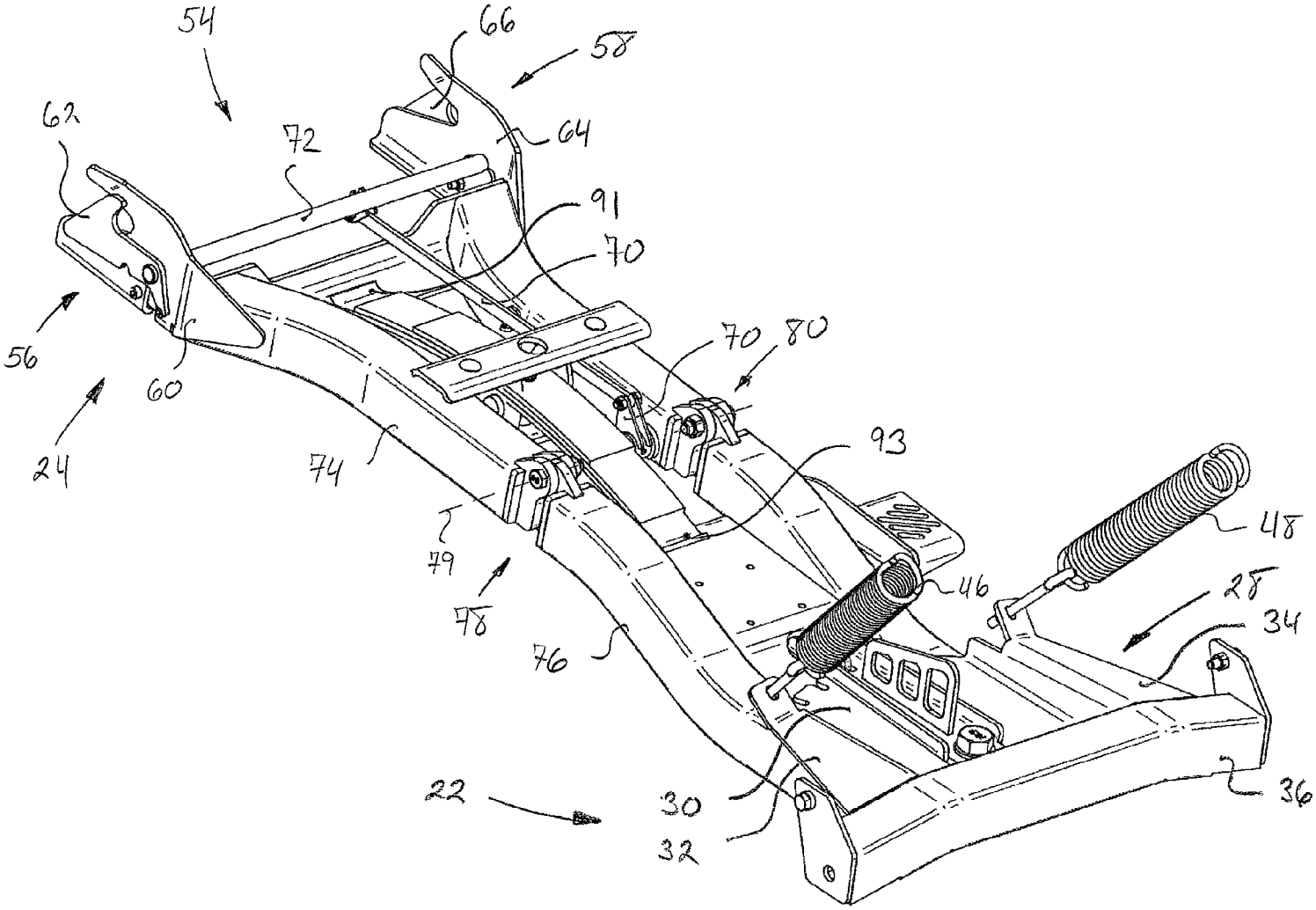
FIG. 3 is a front perspective view of the support frame of FIG. 1, without the plow.

Referring now to FIGS. 1 to 3, the present embodiment of the support frame 20 is shown in greater details.

The support frame 20 generally has a front end 22 and a rear end 24. The front end 22 is configured to support an implement. In the present embodiment, the implement is a plow 26 of typical configuration. In that sense, it is to be understood that the support frame 20 would typically be used to support a plow 26. However, the support frame 20 is not limited to supporting a plow 26 and could therefore support other types of implements.

To properly secure the plow 26 to the front end 22, the support frame 20 generally comprises an attachment plate 28 which is pivotally mounted to the support frame 20, near or at the front end 22. This attachment plate 28 comprises a base portion 30, two lateral wing-shaped portions 32 and 34 extending laterally and upwardly from the base portion 30, and a frontal portion 36 located at the forward extremity of the base portion 30 and of the lateral portions 32 and 34.

As best shown in FIGS. 1 and 2, the plow 26 is pivotally mounted to the frontal portion 36 such as to be pivotable along a substantially horizontal axis 37 (see FIG. 2). However, the frontal portion 36 comprises side stoppers 38 and 40 on which the two back ribs 42 and 44 of the plow 26 can respectively abut to limit the rearward pivotal movements of the plow 26. To limit the forward pivotal movements of the plow 26, a pair of springs 46 and 48 are respectively mounted between the back ribs 42 and 44 and the lateral portions 32 and 34. The springs 46 and 48 generally allow the plow 26 to temporarily pivot forwardly when the plow 26 encounters an obstacle.

The attachment plate 28 is pivotally mounted to the support frame 20 such as to be pivotable along a substantially vertical axis 29 (see FIG. 1). The pivotal movements of the attachment plate 28 allow the angle of the plow 26 to be adjusted with respect to the general longitudinal direction of the support frame 20. In the present embodiment, the angle of the plow 26 can be adjusted via the interaction of an actuatable spring-loaded locking lever 50 and a series of angularly disposed notches 52 formed at the rear extremity of the attachment plate 28 (see FIG. 1).

To adjust the angle of the plow 26, the lever 50 is removed from its current notch 52, the attachment plate 28 is pivoted until the desired angular notch 52 is aligned with the lever 50, and then the lever 50 is inserted into the new notch 52 to lock the attachment plate 28, and thus the plow 26, in its new angular position.

Referring now to FIGS. 1 to 6, the rear end 24 of the support frame 20 comprises a rear attachment mechanism 54 which is configured to pivotally engage the mounting rod (or rods) 16 located underneath the vehicle 10 (see FIGS. 10A to 10C).

In the present embodiment, the rear attachment mechanism 54 is a latching mechanism and comprises two latches 56 and 58 mounted on each side of the support frame 20 near or at the rear end 24. Latch 56 comprises a fixed side plate 60 and a hook-shaped member 62 pivotally mounted thereto. The member 62 is biased into a locked position, i.e. the position shown in the figures, by a biasing member such as a spring (not shown). Similarly, latch 58 comprises a fixed side plate 64 and a hook-shaped member 66 pivotally mounted thereto. The member 66 is also biased into a locked position, i.e. the position shown in the figures, by a biasing member such as a spring (not shown).

Understandably, as the latches 56 and 58 are pushed against the mounting rod 16 during the installation of the support frame 20 on the vehicle 10, the mounting rod 16 will force the members 62 and 66 open. The biasing members will then force the members 62 and 66 in their locked position when the mounting rod 16 is fully inserted into the latches 56 and 58 (see FIGS. 10A to 10C).

The members 62 and 66 can also be pivoted in an unlocked position by an unlocking actuating device 68 (e.g. a pedal that can be depressed by the user) operatively connected to the members 62 and 66 via a linkage assembly 70 and a laterally extending rod 72 fixedly connected to the members 62 and 66.

As indicated above, the pivotal connection between the latches 56 and 58 and the mounting rod 16 allows the support frame 20 to be lowered and raised. This is typically done with the assistance of a winch 18 (and its cable 19) mounted at the front of the vehicle 10 (see FIGS. 10A to 10C).

In other embodiments, the rear attachment mechanism could be different. Still, the rear attachment mechanism needs to allow the support frame 20 to pivot with respect to the frame 12 of the vehicle 10 in order for the support frame 20 to be lowered and raised.

In accordance with the principles of the present invention, the support frame 20 comprises a rear portion 74 and a front portion 76 pivotally mounted thereto. As it will be best understood below with reference to FIGS. 10A to 10C, the front portion 76 can pivot upwardly with respect to the rear portion 74 in order to provide greater ground clearance when the plow 26 is not in use.

In the present embodiment, the rear portion 74 and the front portion 76 are pivotally connected by a pair of hinges 78 and 80 which define a substantially horizontal rotation axis 79 (see FIG. 3). In other embodiments, the rear portion 74 and the front portion 76 could be pivotally connected by only one hinge or by more than two hinges.

Figure 7:
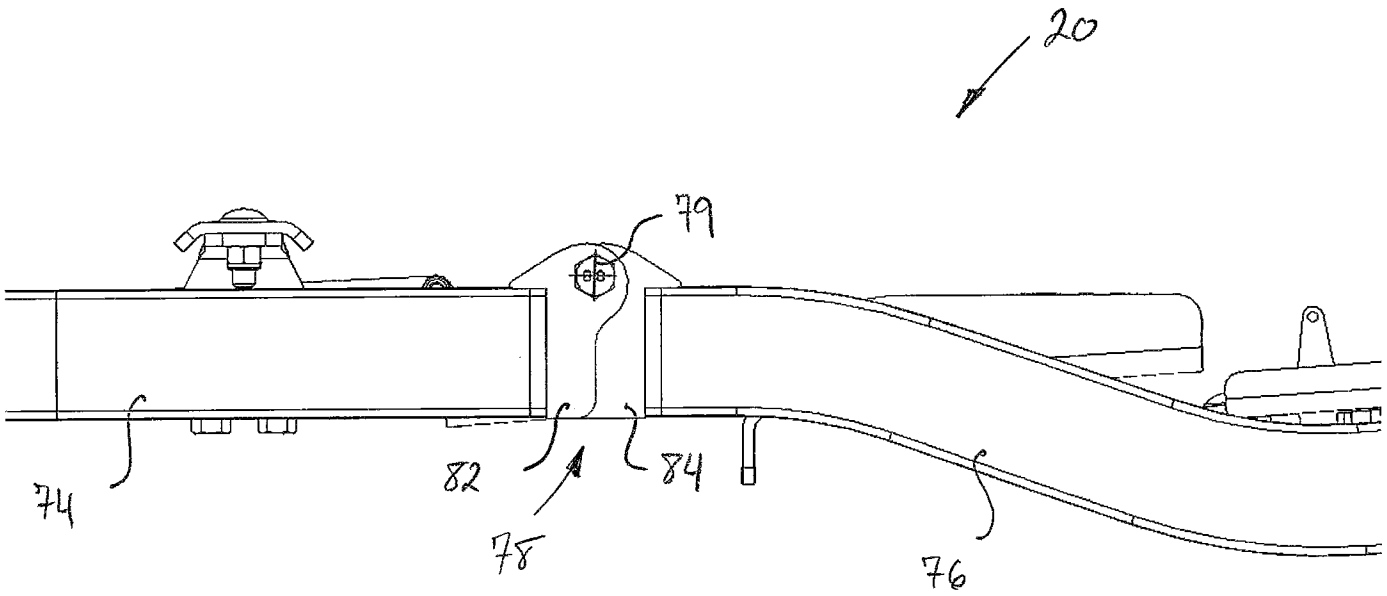
FIG. 7 is a partial side view of the support frame of FIG. 1.
Figure 8:
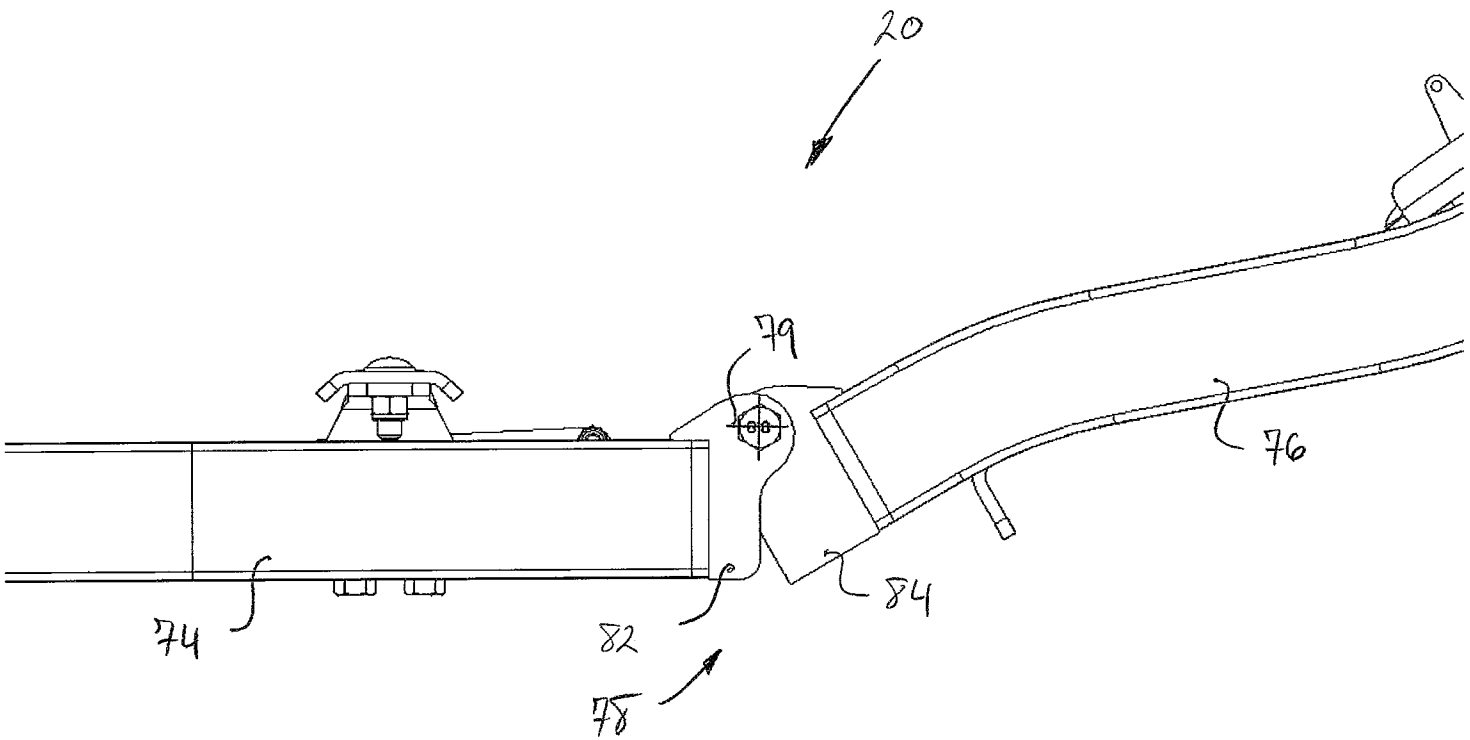
FIG. 8 is another partial side view of the support frame of FIG. 1.
Figure 9:
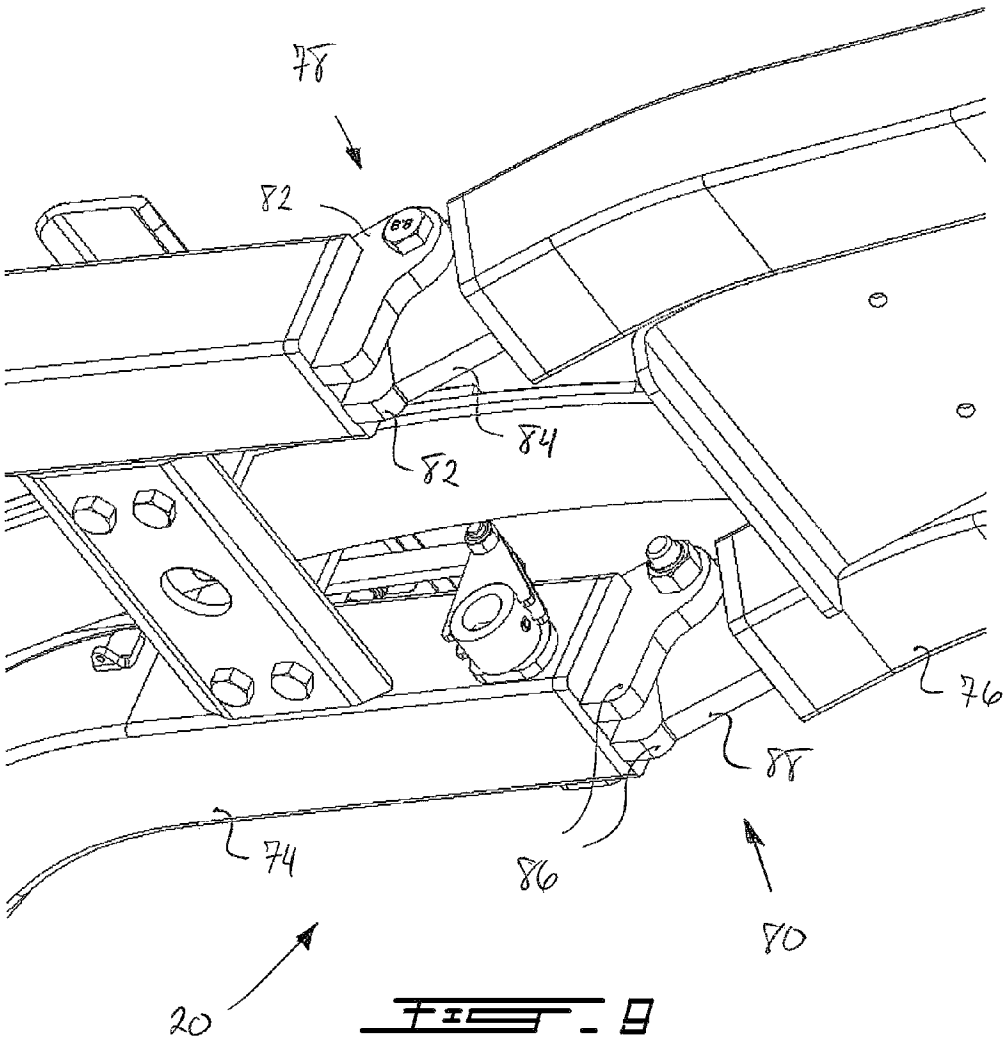
FIG. 9 is a partial bottom perspective view of the support frame of FIG. 1.

Referring now to FIGS. 7 to 9, from an operative position of the front portion 76 (see FIG. 7), the hinges 78 and 80 are configured to allow only upward pivotal movements of the front portion 76 with respect to the rear portion 74, i.e. to an inoperative position (see FIG. 8). In that sense, the rotation axis 79 of the hinges 78 and 80 is located in the upper portion of the hinges 78 and 80 (see FIGS. 7 and 8).

The hinge 78 comprises complementary hinge members 82 and 84 which are respectively secured to the rear portion 74 and to the front portion 76. In the present embodiment, the hinge member 84 is configured to abut on the rear portion 74 when the hinge 78 is closed and thus when the front portion 76 is in its operative position (see FIG. 7). Hence, hinge member 84 prevents the front portion 76 from pivoting downwardly with respect to the rear portion 74. Hinge 80 similarly comprises complementary hinge members 86 and 88 which are respectively secured to the rear portion 74 and to the front portion 76. Hinge 80 functions as hinge 78.

Referring back to FIGS. 3 to 6, to prevent the front portion 76 from freely pivoting upwardly with respect to the rear portion 74, the support frame 20 comprises a biasing assembly 90 which normally biases the front portion 76 in its operative position, i.e. with the hinges 78 and 80 in closed position.

In the present embodiment, the biasing assembly 90 is mounted to the rear portion 74 and generally comprises a leaf spring 92 (i.e. a resilient member) which longitudinally extends between a rear supporting member or plate 94, mounted to the rear portion 74, and a front supporting member or plate 96, mounted to the front portion 76. Still, in the present embodiment, the extremities 91 and 93 of the leaf spring 92 are not secured to the rear supporting plate 94 and to the front supporting plate 96. In fact, the extremities 91 and 93 of the leaf spring 92 respectively rest on the supporting plates 94 and 96 such that they are substantially free to slide on the supporting plates 94 and 96 when the front portion 76 is upwardly pivoted with respect to the rear portion 74.

Figure 6:
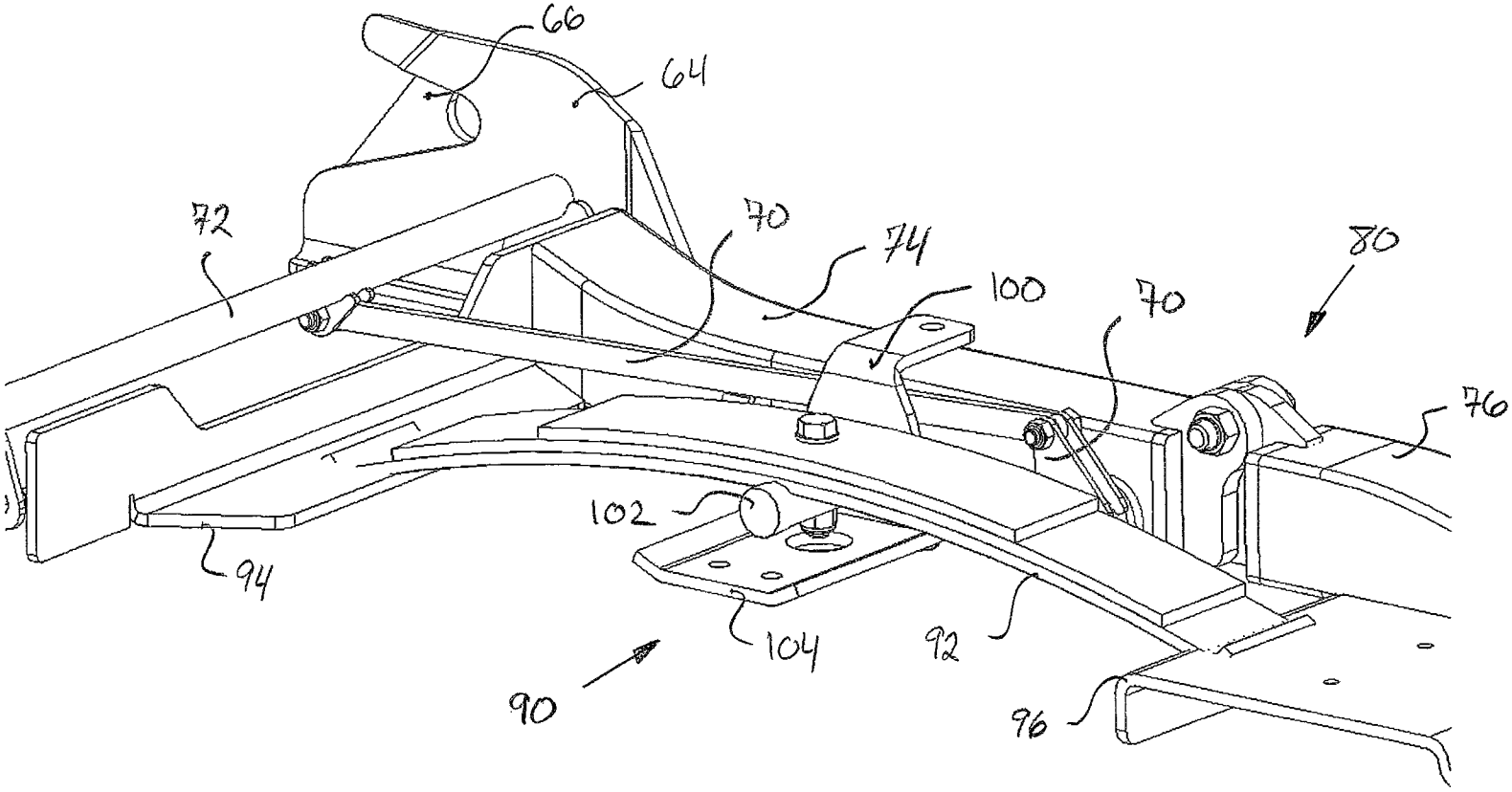
FIG. 6 is another fragmentary side perspective view of the support frame of FIG. 1.

In the present embodiment, the leaf spring 92 is further pivotally mounted to a pair of supporting brackets 98 and 100 via a rod or shaft 102 which is pivotally mounted to the brackets 98 and 100. As illustrated in FIG. 6, in the present embodiment, the leaf spring 92 is secured to the shaft 102 with a fastener (e.g. a bolt and a nut). In other embodiments, the leaf spring 92 could be secured to the shaft 102 using other method such as, but not limited to, welding. In the present embodiment, the resilient member preferably extends from the rear section to the front section beyond a transversal plane defined by the connection pivotally connecting the front and rear sections. Accordingly to one embodiment, the support frame comprises rear and front supporting members wherein the rear intermediate supporting member is laterally positioned with respect to the rear section and wherein the front intermediate supporting member is laterally positioned with respect to the front section. According to one embodiment, the biasing assembly in the operative position traverse a plane formed from the combination of the pivot axis and a vertical axis perpendicular to the support frame. According to one embodiment, the resilient member extends between the rear section and the front section beyond a plane transverse to the support frame positioned at the pivot axis connecting the front and rear sections. According to one embodiment of the present invention, the front section and the rear section may pivot independently with respect to the vehicle. According to one embodiment of the present invention, the rear section comprises a rear intermediate supporting member, while the front section may also comprise a front intermediate supporting member wherein a biasing assembly is mounted to the rear intermediate supporting member and to the front intermediate supporting member. According to another embodiment, the connection between the rear section and the front section may be positioned lower than upper portions of the implement.

Figure 4:
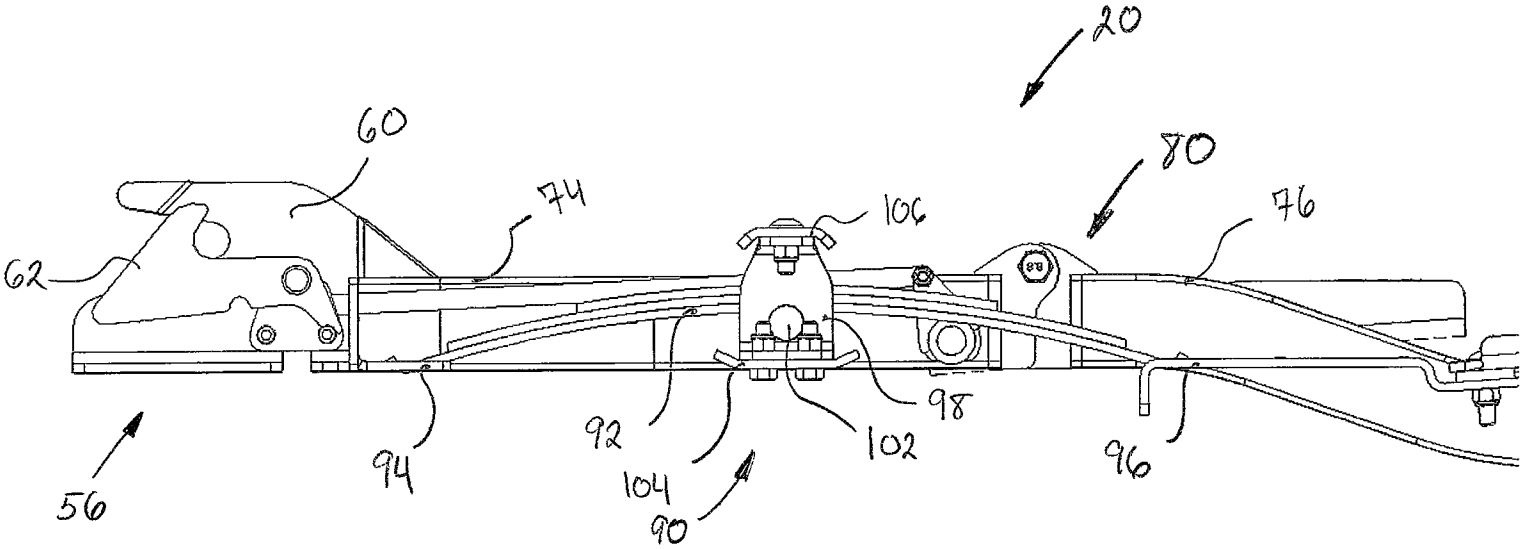
FIG. 4 is a fragmentary side view of the support frame of FIG. 1.
Figure 5:
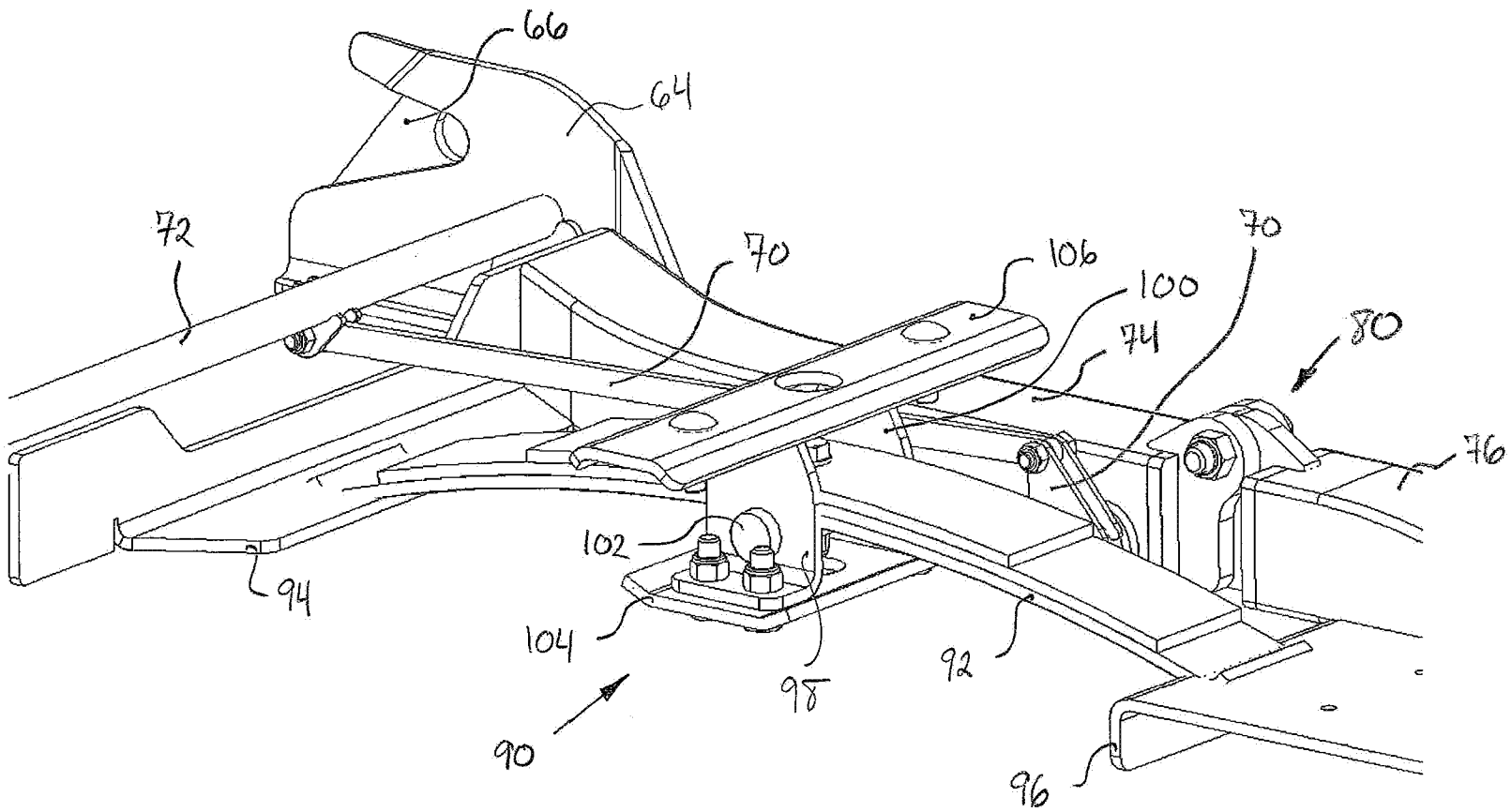
FIG. 5 is a fragmentary side perspective view of the support frame of FIG. 1.

The brackets 98 and 100 are further secured (e.g. fastened, bolted, welded, etc.) to a middle or intermediate supporting member or plate 104 which is itself secured to the rear portion 74 of the support frame 20. As shown in FIGS. 4 to 6, the middle supporting plate 104 is longitudinally located between the rear supporting plate 94 and the front supporting plate 96.

Understandably, in the present embodiment, the load supported by the leaf spring 92 when the front portion 76 is pivoted upwardly with respect to the rear portion 74 is at least partially transferred to the supporting brackets 98 and 100, to the middle supporting plate 104, and thus, to the rear portion 74.

As best illustrated in FIGS. 4 and 5, in the present embodiment, the brackets 98 and 100 also support, in their upper portion, a stopping member or plate (or stopper) 106 which is configured to abut on the underside 14 of the vehicle 10 when the support frame 20 is raised by the winch 18 (see also FIGS. 10B and 10C). Still, in other embodiments, the stopping plate 106 could be mounted elsewhere on the rear portion 74.

In other embodiments, the leaf spring 92 could be differently mounted to the rear portion 74. For instance, in FIGS. 11 to 15, the leaf spring 92 is pivotally mounted to a rod 110, fixedly mounted to the rear portion 74, via a mounting assembly 112. The mounting assembly 112 comprises a top plate 114 and a bottom U-shaped bracket 116 fastened to each other (e.g. with bolts 118 and nuts 120).

Understandably, the biasing assembly 90 can have many different configurations.

Referring now to FIGS. 10A to 10C, the operation of the support frame 20 will be described in details.

As first shown in FIG. 10A, in use, the support frame 20, in its operative position, is pivotally mounted to the frame 12 of the vehicle 10, and more particularly to the mounting rod 16 located underneath the vehicle 10, and the support frame 20 is lowered with the winch 18 such that the plow 26 engages the ground.

When the plow 26 is no longer needed, the support frame 20 is raised with the winch 18 in order to raise the plow 26 from the ground.

As the support frame 20 is raised, the stopping plate 106 ultimately ends up contacting the underside 14 of the vehicle 10 as best shown in FIG. 10B. Understandably, when the stopping plate 106 contacts the underside of the vehicle 10, the rear portion 74 of the support frame 20 cannot be raised any more.

However, as best shown in FIG. 10C and in accordance with the principles of the present invention, since the front portion 76 of the support frame 20 is pivotally mounted to the rear portion 74, the front portion 76 can be further raised as the winch 18 overcomes the downward bias of the biasing assembly 90. Hence, as the winch 18 does overcome the downward bias of the biasing assembly 90, the front portion 76 pivots upwardly with respect to the rear portion 74 which is blocked by the underside 14 of the vehicle 10. This additional upward pivotal movement of the front portion 76 raises the plow 26 further upward, thereby increasing the ground clearance of the plow 26 with respect to the ground (see FIG. 10C).

Understandably, as the plow 26 is needed again, the winch 18 will lower the support frame 20 first from its inoperative position (see FIG. 10C) to its operative position (see FIG. 10B), during which the downward bias of the biasing assembly 90 will close the hinges 78 and 80, and then toward the ground (see FIG. 10A).

By having a second pivoting point located between the rear end 24 and the front end 22, and by allowing the front portion 76 to pivot upwardly with respect to the rear portion 74, the support frame 20 in accordance with the principles of the present invention generally mitigates the problem of ground clearance of underside-mounted implement supporting frames.

Still, it will be understood that the location of the second pivoting point along the support frame 20 will be chosen such to take into account the configuration of the vehicle 10 and more particularly the position underneath the vehicle 10 where the rear end 24 of the support frame 20 will be mounted with respect to the front extremity of the vehicle 10.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A support frame for a vehicle, the support frame comprising a rear end configured to be removably mounted to an underside of the vehicle, and a front end operatively mounted to an implement, the implement having a blade transverse to the support frame located in front of the vehicle, the support frame comprising a rear section and a front section pivotally connected thereto, the front section being actively pivotable between an operative position and an inoperative position, and a biasing assembly mounted to the support frame and biasing the front section into the operative position, wherein the biasing assembly comprises a resilient member extending between the rear section and the front section, wherein the front section comprises a front supporting member, wherein the rear section comprises a rear supporting member, wherein the support frame comprises an intermediate supporting member located between the rear supporting member and the front supporting member, and wherein the resilient member rests on the rear supporting member and on the front supporting member and is connected to the intermediate supporting member.

2. A support frame as claimed in claim 1, wherein the support frame comprises a rear attachment mechanism at the rear end for removably mounting the support frame to the underside of the vehicle.

3. A support frame as claimed in claim 2, wherein the rear attachment mechanism allows the support frame to pivot with respect to the vehicle.

4. A support frame as claimed in claim 2, wherein the rear attachment mechanism comprises at least one latch.

5. A support frame as claimed in claim 2, wherein the rear attachment mechanism comprises a pair of latches.

6. A support frame as claimed in claim 1, wherein the support frame comprises a front attachment assembly at the front end for supporting the implement.

7. A support frame as claimed in claim 6, wherein the front attachment assembly comprises an attachment plate pivotally mounted to the support frame.

8. A support frame as claimed in claim 1, wherein the intermediate supporting member is connected to the rear section.

9. A support frame as claimed in claim 1, wherein the rear section comprises a stopping element configured to abut on the underside of the vehicle when the support frame is raised.

10. A support frame as claimed in claim 1, having the implement mounted thereto.

11. A support frame as claimed in claim 10, wherein the implement is a plow.

12. A vehicle having mounted thereto a support frame as claimed in claim 1.

13. A support frame as claimed in claim 1, wherein the front section is hingedly connected to the rear section such as to be pivotable between an operative position wherein the front section is substantially not pivoted with respect to the rear section, and an inoperative position wherein the front section is upwardly pivoted with respect to the rear section, and wherein the biasing mechanism biases the front section into the operative position.

14. A support frame as claimed in claim 6, wherein the front attachment assembly is pivotally mounted to the support frame.

15. A support frame as claimed in claim 1, wherein the resilient member is pivotally connected to the intermediate supporting member.

16. A vehicle having mounted thereto a support frame as claimed in claim 13.

* * * * *